US005374499A

United States Patent [19]

Sasaoka et al.

[11] Patent Number: 5,374,499

[45] Date of Patent: Dec. 20, 1994

[54] SILVER HALIDE PHOTOGRAPHIC MATERIAL

[75] Inventors: Senzo Sasaoka; Morio Yagihara, both of Kanagawa, Japan

[73] Assignee: Fuji Photo Film Co., Ltd., Kanagawa, Japan

[21] Appl. No.: 161,451

[22] Filed: Dec. 6, 1993

Related U.S. Application Data

[63] Continuation of Ser. No. 985,446, Dec. 3, 1992, abandoned, which is a continuation of Ser. No. 794,672, Nov. 18, 1991, abandoned, which is a continuation of Ser. No. 522,875, May 14, 1990, abandoned.

[30] Foreign Application Priority Data

May 15, 1989 [JP] Japan ..... 1-120640

[51] Int. Cl.[5] ..... G03C 1/34

[52] U.S. Cl. ..... 430/264; 430/551; 430/556; 430/607; 430/613; 430/614; 430/966

[58] Field of Search ..... 430/264, 551, 566, 607, 430/966, 613, 614

[56] References Cited

U.S. PATENT DOCUMENTS

| | | | |
|---|---|---|---|
| 4,310,621 | 1/1982 | Oderwalder et al. | 430/443 |
| 4,332,878 | 6/1982 | Akimura et al. | 430/264 |
| 4,377,634 | 3/1983 | Mifune et al. | 430/564 |
| 4,459,351 | 7/1984 | Adin et al. | 430/445 |
| 4,740,453 | 4/1988 | Nakamura et al. | 430/505 |
| 4,761,362 | 8/1988 | Sasaoka et al. | 430/267 |
| 4,845,020 | 7/1989 | Itoh et al. | 430/598 |
| 4,977,062 | 12/1990 | Yagihara et al. | 430/264 |

FOREIGN PATENT DOCUMENTS

| | | | |
|---|---|---|---|
| 2758765 | 3/1979 | Germany | 430/566 |

*Primary Examiner*—Janet C. Baxter
*Attorney, Agent, or Firm*—Sughrue, Mion, Zinn, Macpeak & Seas

[57] ABSTRACT

A silver halide photographic material comprising a support having thereon at least one of a surface latent image type silver halide emulsion layer and other hydrophilic colloid layers is disclosed, in which said at least one of the emulsion layer and other hydrophilic colloid layers contains a compound represented by formula (I):

(I)

wherein X represents $R_1$ represents a hydrogen atom or a group capable of being converted to a hydrogen atom on hydrolysis; $R_2$, $R_3$ and $R_4$, which may be the same or different, each represents a hydrogen atom or a substituent group; $R_5$ and $R_6$, which may be the same or different, each represents a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group, or a substituted or unsubstituted carbamoyl group; Y represents a group which accelerates adsorption onto silver halide grains; L represents a divalent linking group; and m represents 0 or 1.

The photographic material has suitability for rapid processing and markedly improved abrasion resistance without undergoing reduction in sensitivity.

8 Claims, No Drawings

SILVER HALIDE PHOTOGRAPHIC MATERIAL

This is a continuation application of pending prior parent application Ser. No. 07/985,446 filed on Dec. 3, 1991, now abandoned which is a continuation application of Ser. No. 07/794,672 filed Nov. 18, 1991, now abandoned which is a continuation application Ser. No. of 07/522,875 filed May 14, 1990, now abandoned.

FIELD OF THE INVENTION

This invention relates to silver halide photographic materials, and more particularly to silver halide photographic materials suitable as X-ray films, light-sensitive materials for photomechanical process, films for microphotography, negative films for general photography, and the like which have improved resistance to abrasion mark or stress mark (due to pressure sensitization) caused by abrasion with themselves.

BACKGROUND OF THE INVENTION

In the field of light-sensitive materials, techniques of rapid processing have recently been progressing very fast. Achievement of rapid exposure requires reduction of exposure time (increase of photographic speed), transfer properties in an exposure apparatus, e.g., cameras and scanners, toughness on handling, and the like. Speeding up of development is achieved by high temperature rapid development by using an automatic developing machine, and achievement of reduction of development time requires a light-sensitive material which has high development rate and can be dried in a reduced time after being washed with water.

In X-ray films, light-sensitive materials for microphotography, and negative films for general photography, improvement in covering power (i.e., optical density per unit silver amount) is essential for accomplishing an increase of photographic speed. It is known that a covering power can be improved by reducing the amount of gelatin as disclosed, e.g., in JP-A-61-116347 and JP-A-57-182732 (the term "JP-A" as used herein means an "unexamined published Japanese patent application"). However, reduction of gelatin amount relative to silver amount tends to cause abrasion marks, i.e., blackening of scratches of light-sensitive materials due to rubbing with each other.

Where tabular silver halide grains having a high aspect ratio are used for the purpose of increasing photographic speed, the light-sensitive materials tend to suffer from stress marks due to abrasion or bending during handling before development processing.

Further, reduction of the amount of a binder for the purpose of improving development rate and increasing drying speed after washing easily causes deterioration in graininess or an increase of stress marks on handling.

It has been proposed to improve both abrasion resistance and covering power by incorporating a water-soluble polyester into light-sensitive materials as disclosed in JP-A-64-29834. This technique, however, does not bring about a complete solution to the above-described problems, still leaving a need of further improvements.

In the field of photomechanical process, systems of stably and rapidly forming a ultra-high contrast negative image having a gamma exceeding 10 while eliminating instability observed in conventional image formation systems using lith development have been developed as described in U.S. Pat. Nos. 4,166,742, 4,168,977, 4,221,857, 4,224,401, 4,243,739, 4,272,606, and 4,311,781. According to these systems, a hydrazine compound is used to achieve an increased sensitivity and an increased contrast, while making it possible to greatly speed up processing (development time: 20 to 30 seconds) over the lith development systems (development time: 60 to 100 seconds). Nevertheless, in spite of the high sensitivity and ultra-high contrast achieved, the systems involve a disadvantage that the light-sensitive materials tend to suffer from rather amplified abrasion marks, stress marks, etc.

JP-A-62-21143 and JP-A-56-1936 propose an improvement to be added to the ultra-high contrast image formation systems using a hydrazine compound, in which hydroquinone or a substituted polyhydroxybenzene is used to improve resistance to stress marks. Further, JP-A-54-40629 discloses use of a substituted hydroquinone, and especially hydroquinone substituted with a thio group for the improvement of sensitivity and contrast. All these hydroquinone derivatives are different from the compounds according to the present invention.

SUMMARY OF THE INVENTION

An object of this invention is to settle down the above-described problems associated with conventional techniques and to provide a silver halide photographic material having improved resistance against abrasion marks or stress marks during handling as well as high sensitivity and suitability to rapid development.

It has now been found that the object of this invention is accomplished by a silver halide photographic material comprising a support having thereon at least one of a surface latent image type silver halide emulsion layer and other hydrophilic colloid layers, wherein said at least one of the emulsion layer and other hydrophilic colloid layers contains a compound represented by formula (I):

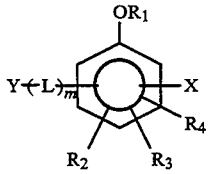

(I)

wherein X represents

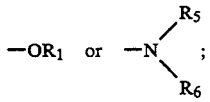

$R_1$ represents a hydrogen atom or a group capable of being converted to a hydrogen atom on hydrolysis; $R_2$, $R_3$ and $R_4$, which may be the same or different, each represents a hydrogen atom or a substituent group; $R_5$ and $R_6$, which may be the same or different, each represents a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group, or a substituted or unsubstituted carbamoyl group; Y represents a group which accelerates adsorption onto silver halide grains; L represents a divalent linking group; and m represents 0 or 1.

DETAILED DESCRIPTION OF THE INVENTION

In formula (I), the group capable of being converted to a hydrogen atom by hydrolysis as represented by $R_1$ includes —$COR_7$ (wherein $R_7$ represents a substituted or unsubstituted alkyl group (preferably having from 1 to 20 carbon atoms and more preferably from 1 to 10 carbon atoms), a substituted or unsubstituted aryl group (preferably having from 6 to 20 carbon atoms), or a substituted or unsubstituted amino group) and

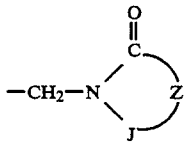

(wherein J represents

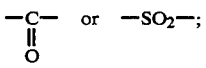

and Z represents an atomic group necessary to format least one 5- or 6-membered heterocyclic ring).

The substituent group as represented by $R_2$, $R_3$, or $R_4$ includes a halogen atom (e.g., fluorine, chlorine, and bromine), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably an alkanoylamino group having from 1 to 20 carbon atoms or a benzoylamino group having from 6 to 20 carbon atoms), a nitro group, a cyano group, an oxycarbonyl group (preferably an alkoxycarbonyl group having from 1 to 20 carbon atoms or an aryloxycarbonyl group having from 6 to 20 carbon atoms), a carboxyl group, a sulfo group, a ureido group (preferably an alkylureido group having from 1 to 20 carbon atoms or an arylureido group having from 6 to 20 carbon atoms), a sulfonamido group (preferably an alkylsulfonamido group having from 1 to 20 carbon atoms or an arylsulfonamido group having from 6 to 20 carbon atoms), a sulfamoyl group (preferably an alkylsulfamoyl group having from 1 to 20 carbon atoms or an arylsulfamoyl group having from 6 to 20 carbon atoms), a carbamoyl group (preferably an alkylcarbamoyl group having from 1 to 20 carbon atoms or an arylcarbamoyl group having 6 to 20 carbon atoms), an acyloxy group (preferably having from 1 to 20 carbon atoms), a substituted or unsubstituted amino group (preferably a secondary or tertiary amino group substituted with an alkyl group having from 1 to 20 carbon atoms or an aryl group having from 6 to 20 carbon atoms), a carbonic acid ester group (preferably an alkyl carbonate group having from 1 to 20 carbon atoms or an aryl carbonate group having from 6 to 20 carbon atoms), a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), a hydroxyl group, and $\text{-}(\text{L})_m\text{-}Y$.

$R_2$, $R_3$, and $R_4$ may be the same or different. Where any two of them are bonded to carbon atoms adjacent to each other on the benzene ring, they may be taken together to form a 5- to 7-membered carbocyclic ring or heterocyclic ring which may be either saturated or unsaturated. Specific examples of such a ring include a cyclopentane ring, a cyclohexane ring, a cycloheptane ring, a cyclopentane ring, a cyclohexadiene ring, a cycloheptadiene ring, an indane ring, a norbornane ring, a norbornene ring, and a pyridine ring. These rings may be substituted.

The total number of carbon atoms contained in $R_2$, $R_3$, and $R_4$ is preferably from 1 to 10.

$R_5$ and $R_6$, which may be the same or different, each represents a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group, or a substituted or unsubstituted carbamoyl group, or they may be taken together to form a nitrogen-containing heterocyclic ring (e.g., morpholino, piperidino, pyrrolidino, imidazolyl, and piperazino). The alkyl portion of substituent groups for $R_5$ and $R_6$ as described above has preferably from 1 to 20 carbon atoms and more preferably from 1 to 10 carbon atoms and the aryl portion of the substituent groups as described above has preferably 6 to 20 carbon atoms.

Suitable substituents of $R_5$ or $R_6$ include those enumerated above as a substituent group with respect to $R_2$, $R_3$, and $R_4$ and $\text{-}(\text{L})_m\text{-}Y$. $R_5$ and $R_6$ each preferably represents a hydrogen atom.

X is preferably bonded at the ortho- or para-position with respect to —$OR_1$. X is preferably represents —$OR_1$, and more preferably —OH.

Y is a group accelerating adsorption onto silver halide grains (hereinafter referred to as adsorption accelerating group); L is a divalent linking group; and m is 0 or 1. Suitable adsorption accelerating groups include a thioamido group, a mercapto group, a group having a disulfide linkage, and a 5- or 6-membered nitrogen-containing heterocyclic group.

The thioamido adsorption accelerating group represented by Y is a divalent group represented by

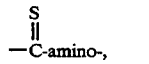

which may be a part of a cyclic structure or a may be an acyclic thioamido group. Useful thioamido adsorption accelerating groups are described in U.S. Pat. Nos. 4,030,925, 4,031,127, 4,080,207, 4,245,037, 4,255,511, 4,266,013, and 4,276,364, *Research Disclosure*, Vol. 151, No. 15162 (November, 1976), and ibid, Vol. 176, No. 17626 (December, 1978).

Specific examples of the acyclic thioamido group include thioureido, thiourethane, and dithiocarbamic ester groups. Specific examples of the cyclic thioamido group include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These thioamido groups may be substituted.

The mercapto adsorption accelerating group represented by Y includes an aliphatic mercapto group, an aromatic mercapto group, and a heterocyclic mercapto group (a heterocyclic mercapto group wherein the carbon atom to which —SH is bonded is adjacent to a nitrogen atom has the same meaning as a cyclic thioamido group, which is in a tautomeric relation with such a heterocyclic mercapto group, and the specific examples thereof are the same as those mentioned above with respect to the cyclic thioamido group.).

The 5- or 6-membered nitrogen-containing heterocyclic group represented by Y include those composed of a combination of nitrogen, oxygen, sulfur, and carbon atoms. Preferred of them are benzotriazole, triazole, tetrazole, indazole, benzimidazole, imidazole, benzothiazole, thiazole, benzoxazole, oxazole, thiadiazole, oxadiazole, and triazine. These heterocyclic groups may be substituted.

Suitable substituents for these heterocyclic groups are the same as the groups mentioned above as $R_2$, $R_3$, and $R_4$.

Of the groups represented by Y, preferred are a cyclic thioamido group (i.e., mercapto-substituted nitrogen-containing heterocyclic group, e.g., 2-mercaptothiadiazole, 3-mercapto-1,2,4-triazole, 5-mercaptotetrazole, 2-mercapto-1,3,4-oxadiazole, and 2-mercaptobenzoxazole) and a nitrogen-containing heterocyclic group (e.g., benzotriazole, benzimidazole, and indazole).

Two or more $Y\text{-}(L)_m$ moieties which may be the same or different may be bonded to the benzene ring.

The divalent linking group represented by L is an atom or atomic group containing at least one of C, N, S, and O, including an alkylene group, an alkenylene group, an alkynylene group, an arylene group, —O—, —S—, —NH—, —N=, —CO—, —$SO_2$—, and combinations thereof. These groups may be substituted. Specific examples of L are shown below.

—CONH—, —NHCONH—, —$SO_2$NH—, —COO—,

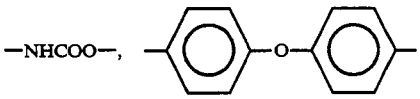

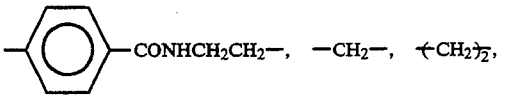

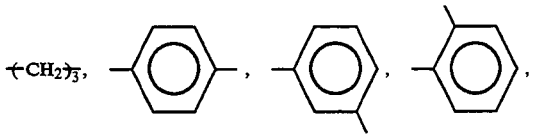

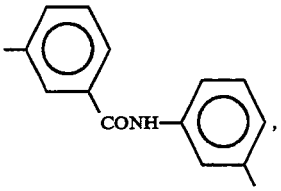

-continued

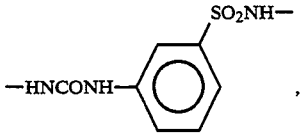

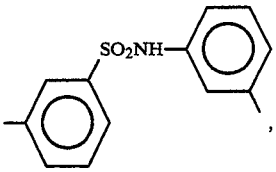

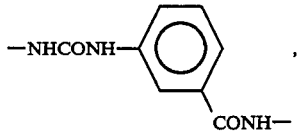

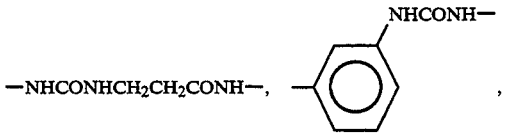

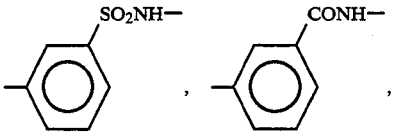

—$CH_2CH_2SO_2NH$—, —$CH_2CH_2CONH$—.

The divalent linking groups illustrated above may have appropriate substituents selected, for example, from among those mentioned above as substituent groups represented by $R_2$, $R_3$, or $R_4$.

Specific examples of the compound represented by formula (I) which can be preferably used in the present invention are shown below for illustrative purposes only but not for limitation.

I-1)

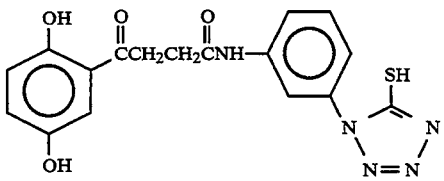

I-2)

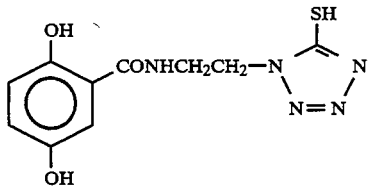

I-3)

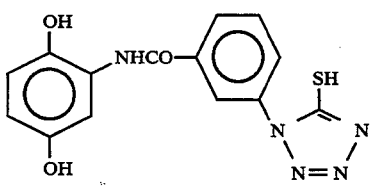

-continued
I-4)
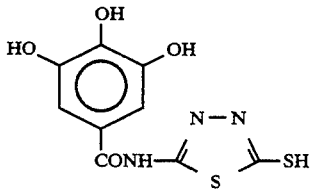
I-5)
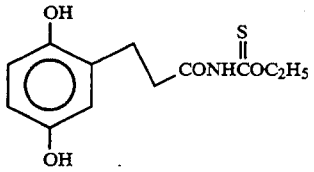
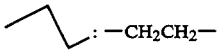
I-6)
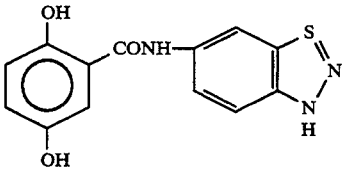
I-7)
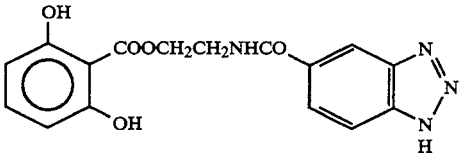
I-8)
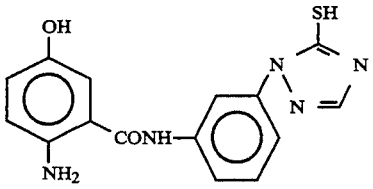
I-9)
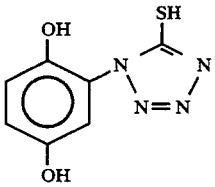
I-10)
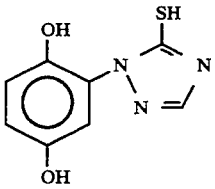
I-11)
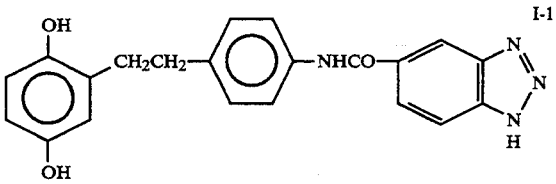
-continued
I-12)
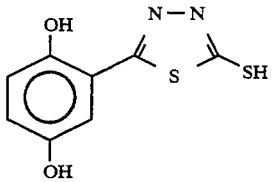
I-15)
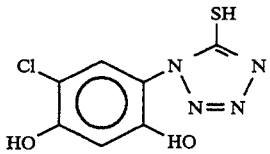
I-16)
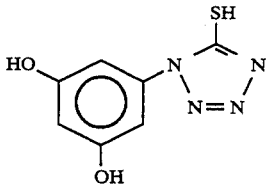
I-17)
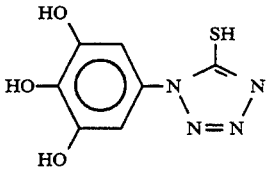
I-18)
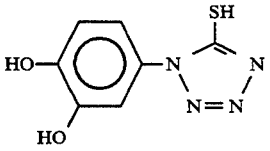
I-20)
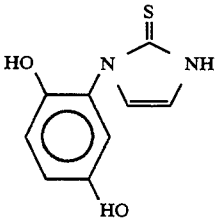
I-21)
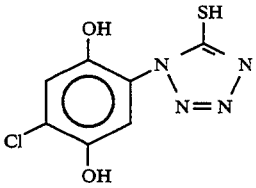
I-22)
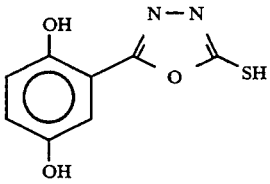

-continued

I-23)

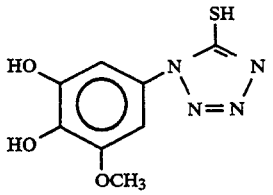

A typical example of the method for synthesizing the compound represented by formula (I) is described below.

SYNTHESIS EXAMPLE

Synthesis of Compound I-11

5-Phenylbenzotriazole carbonate (23.8 g; 0.1 mol), 25.2 g (0.11 mol) of 2-(4-aminophenyl)-ethylhydroquinone, and 100 ml of dimethylacetamide (DMAC) were heated in an oil bath at 120° C. (external temperature) for 5 hours while stirring in a nitrogen stream. DMAC was removed by distillation under reduced pressure, and 200 ml of methanol was added to the residue, whereupon a trace amount of a by-produced black precipitate was formed as an insoluble matter, which was then removed by filtration by suction. Methanol was removed from the filtrate by distillation under reduced pressure, and the resulting reaction mixture was purified by silica gel column chromatography using chloroform/methanol (4/1 by volume) as an eluent. The product was washed with methanol to recover 14.4 g (38.5%) of Compound I-11 having a melting point of 256 to 257° C.

The compound represented by formula (I) is preferably used in an amount of from $1\times10^{-5}$ to $1\times10^{-1}$ mol, and more preferably from $1\times10^{-4}$ to $5\times10^{-2}$ mol, per mol of the silver halide.

In the present invention, a known hydrazine compound can be used in combination.

Hydrazine derivatives which can be used in the invention preferably include those represented by formula (II):

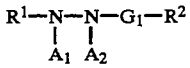

(II)

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, a substituted or unsubstituted aryloxy group, a substituted or unsubstituted amino group, or a substituted or unsubstituted hydrazino group;

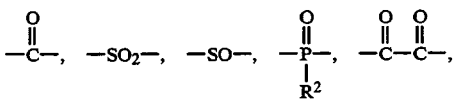

a thiocarbonyl group, or an iminomethylene group; and $A_1$ and $A_2$ each represents a hydrogen atom, a substituted or unsubstituted alkylsulfonyl group, a substituted or unsubstituted arylsulfonyl group, or a substituted or unsubstituted acyl group, provided that at least one of $A_1$ and $A_2$ is a hydrogen atom.

In formula (II), the aliphatic group represented by $R^1$ preferably contains from 1 to 30 carbon atoms, and more preferably is a substituted or unsubstituted, and straight or branched chain or cyclic alkyl group having from 1 to 20 carbon atoms.

The aromatic group represented by $R^1$ is a monocyclic or bicyclic aryl group or unsaturated heterocyclic group. The unsaturated heterocyclic group may be condensed with an aryl group.

$R^1$ preferably represents an aryl group, and more preferably an aryl group containing a benzene ring.

The aliphatic or aromatic group represented by $R^1$ may have a substituent(s). Typical examples of the substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric acid amide group, a diacylamino group, a sulfonamide group, an acylamino

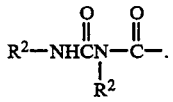

Preferred of these substituents are an alkyl group (preferably having from 1 to 20 carbon atoms), an aralkyl group (preferably having from 7 to 30 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamide group (preferably having from 1 to 30 carbon atoms), a ureido group (preferably having from 1 to 30 carbon atoms), and a phosphoric acid amido group (preferably having from 1 to 30 carbon atoms).

The alkyl group as represented by $R^2$ preferably contains from 1 to 4 carbon atoms, and the aryl group as represented by $R^2$ is preferably a monocyclic or bicyclic aryl group (e.g., an aryl group containing a benzene ring).

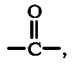

$R^2$ preferably represents a hydrogen atom, an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, and 2-hydroxymethylphenyl), and more preferably a hydrogen atom.

$R^2$ may have a substituent(s) selected, for example, from the substituents enumerated with respect to $R^1$.

$G_1$ most preferably represents

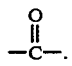

$R^2$ may be a group which functions to split the $G_1$—$R^2$ moiety off the rest of the structure of formula (II) to induce a cyclization reaction to form a cyclic structure containing the —$G_1$—$R^2$ moiety. Examples of such a group are described, e.g., in JP-A-63-29751.

$A_1$ and $A_2$ each most preferably represents a hydrogen atom $R^1$ or $R^2$ may contain a ballast group or a polymer commonly employed in immobile photographic additives, such as couplers. The ballast group is a group containing 8 carbon atoms or more and relatively inert to photographic characteristics, for example, an alkyl group, an alkoxy group, a phenyl group, an alkylphenyl group, a phenoxy group, and an alkylphenoxy group. The polymer includes those described in JP-A-1-100530.

$R^1$ or $R^2$ may further contain a group which accelerates adsorption onto silver halide grain surfaces. Such an adsorption accelerating group includes a thiourea group, a heterocyclic thioamide group, a mercapto heterocyclic group, and a triazole group as described in U.S. Pat. Nos. 4,385,108 and 4,459,347, JP-A-59-195233, JP-A-59-200231, JP-A-59-201045 to 201049, JP-A-61-170733, JP-A-61-270744, JP-A-62-948, JP-A-63-234244 and JP-A-63-234246.

Specific examples of the hydrazine derivatives represented by formula (II) are shown below for illustrative purposes only but not for limitation.

II-1)

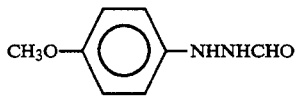

II-2)

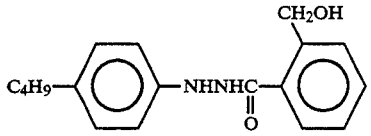

II-3)

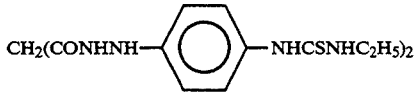

II-4)

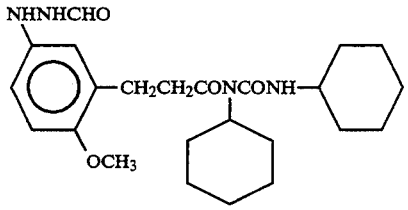

II-5)

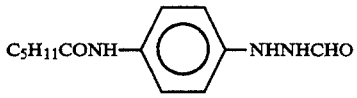

II-6)

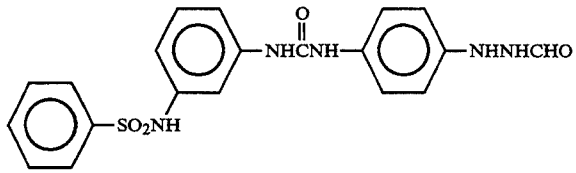

II-7)

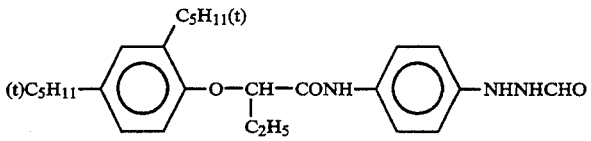

II-8)

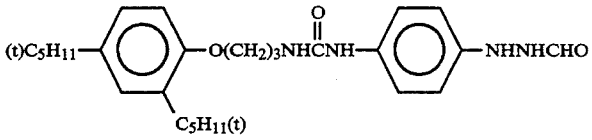

-continued
II-9)
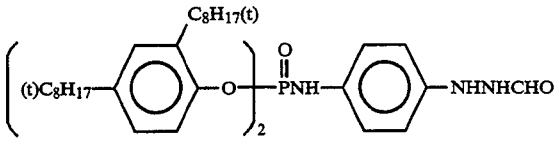
II-10)
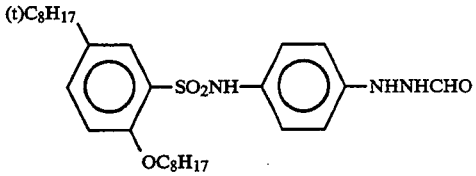
II-11)
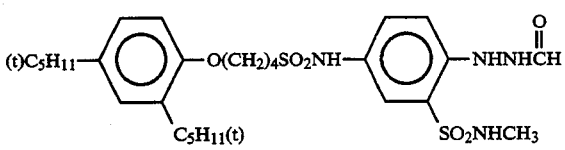
II-12)
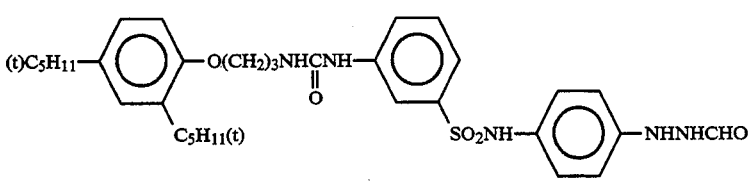
II-13)
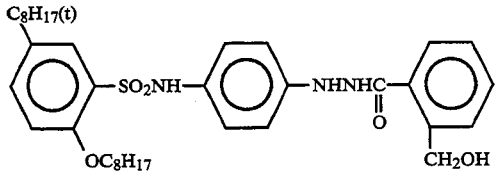
II-14)
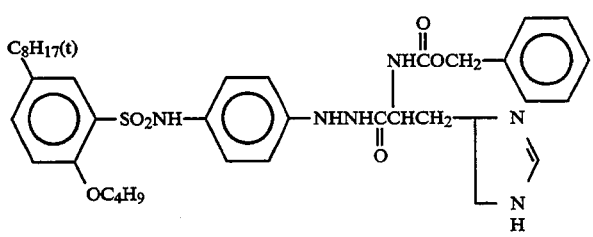
II-15)
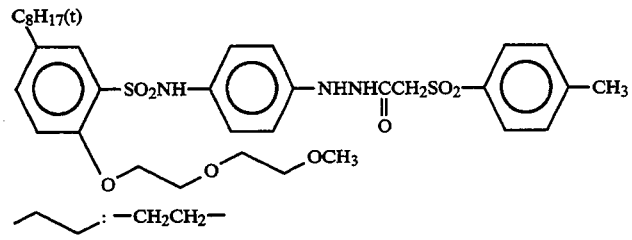
II-16)
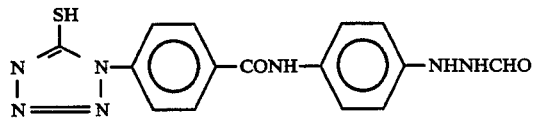
II-17)
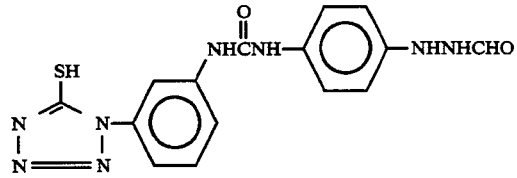

-continued
II-18)
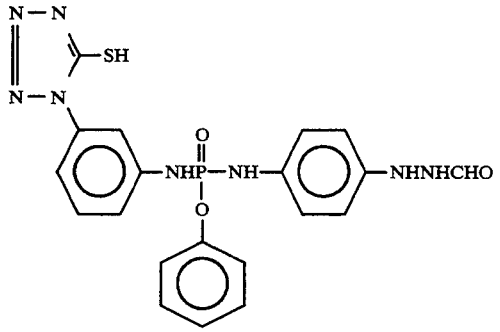
II-19)
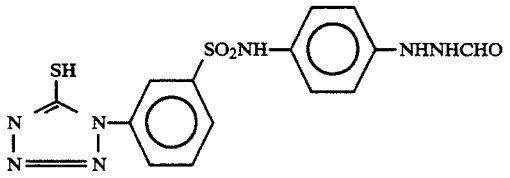
II-20)
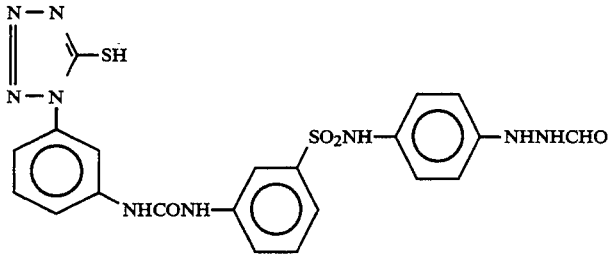
II-21)
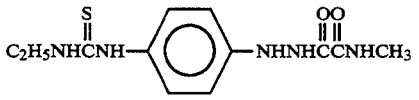
II-22)
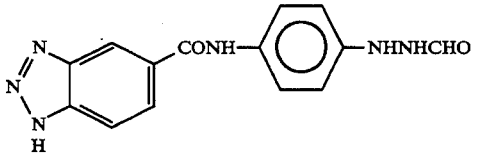
II-23)
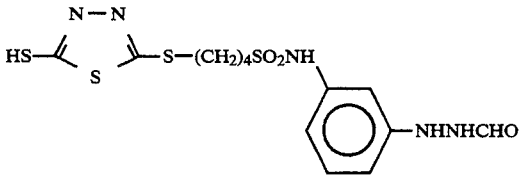
II-24)
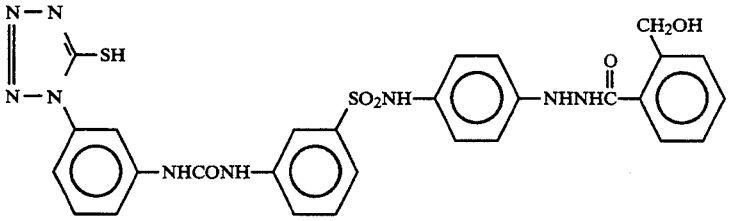

-continued

II-25)

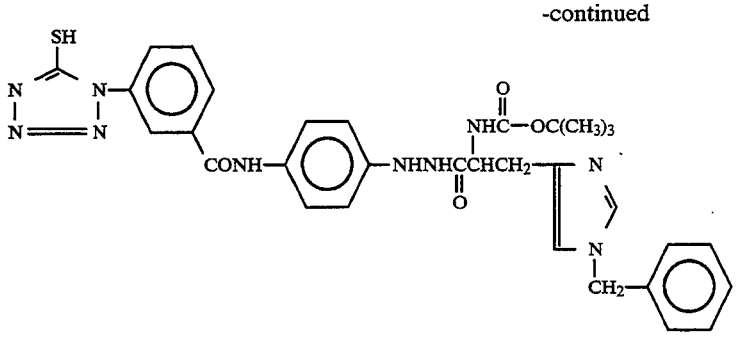

II-26)

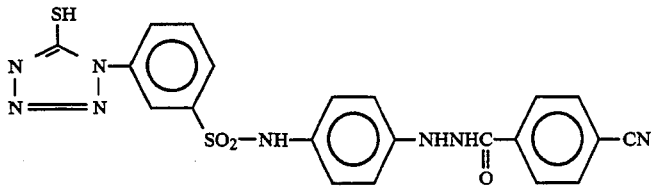

In addition to the above-illustrated compounds, hydrazine derivatives described in the following references can also be used in the present invention: *Research Disclosure*, No. 23516, p. 346 (November, 1983) and references cited therein, U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, JP-A-62-948, EP 217,310, U.S. Pat. No. 4,686,167, JP-A-62-178246, JP-A-63-32538, JP-A-63-104047, JP-A-63-121838, JP-A-63-129337, JP-A-63-223744, JP-A-63-234244 to 234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, and Japanese Patent Application Nos. 63-147339, 63-179760, 63-229163, 1-18377 to 18379, 1-15755, 1-16814, 1-40792, 1-42615, 1-42616, 1-123693, and 1-126284.

The hydrazine derivative is preferably used in an amount of from $1\times10^{-6}$ to $5\times10^{-2}$ mol, and more preferably from $1\times10^{-5}$ to $2\times10^{-2}$ mol, per mol of the silver halide.

The compounds represented by formulae (I) and (II) can be incorporated into the photographic material by adding to a silver halide emulsion solution for a surface latent image type silver halide emulsion layer or a hydrophilic colloidal solution for a hydrophilic colloid layer in the form of an aqueous solution thereof where they are water-soluble, or in the form of a solution in a water-miscible organic solvent such as alcohols (e.g., methanol and ethanol), esters (e.g., ethyl acetate), and ketones (e.g., acetone) where they are water-insoluble.

When the compounds represented by formulae (I) and (II) are added to a silver halide emulsion solution, the addition is at any stage from the commencement of chemical ripening through coating, preferably after completion of chemical ripening, and more preferably immediately before coating.

Examples of the above hydrophilic colloid layer include an emulsion layer, a protective layer, an interlayer and a subbing layer. The layer in which the compound represented by formula (I) is incorporated is preferably an emulsion layer, and the layer in which the compound represented by formula (II) is incorporated is preferably an emulsion layer and a hydrophilic colloid layer adjacent to an emulsion layer.

Silver halide emulsions which can be used in the present invention can be prepared according to a process as described in P. Glafkides, *Chimie et Physique Photographique*, Paul Montel (1967), G. F. Duffin, *Photographic Emulsion Chemistry*, The Focal Press (1966), and V. L. Zelikman, et al., *Making and Coating Photographic Emulsion*, The Focal Press (1964), a conversion process as described in U.S. Pat. Nos. 2,592,250 and 4,075,020 or a process for preparing core/shell type emulsions as described in British Patent 1,027,146.

The methods of reacting a water-soluble silver salt (e.g., silver nitrate aqueous solution) and a water-soluble halogen salt includes a single jet process, a double jet process, and a combination thereof. A modified double jet process, in which a pAg value of the liquid phase where silver halide grains are formed is maintained constant, i.e., a so-called controlled double jet process, can also be employed.

Silver halide grains may be formed by using a so-called silver halide solvent, such as ammonia, thioethers, and tetra-substituted thioureas.

When the controlled double jet process or the process of using a silver halide solvent is followed, silver halide emulsions having a regular crystal form and a narrow grain size distribution can easily be prepared.

Silver halide grains in the photographic emulsions may have a relatively broad size distribution but preferably has a narrow size distribution. It is particularly preferable that the size of 90% of the weight or number of the total silver halide grains fall within ±40% of the mean grain size. An emulsion having such a grain size distribution is generally called a mono-dispersed emulsion.

Silver halide grains may have a regular crystal form, such as a cubic form and an octahedral form, or an irregular crystal form, such as a spherical form and a plate form, or a composite form thereof.

Individual silver halide grains may comprise a homogeneous phase or may be composed of different phases between the inside and the surface thereof.

Two or more different kinds of silver halide emulsions separately prepared may be used as a mixture.

During silver halide grain formation or physical ripening, a cadmium salt, a sulfite salt, a lead salt, a thallium salt, an iridium salt or a complex salt thereof, a rhodium salt or a complex salt thereof, etc. may be present in the system.

The silver halide emulsions to be used in this invention may or may not be chemically sensitized. Chemical sensitization is carried out by gold sensitization either alone or in combination with sulfur sensitization, reduction sensitization, noble metal sensitization, or the like technique.

Gold sensitization which is a typical technique of noble metal sensitization, is conducted by using a gold compound, mostly a gold complex salt. Noble metal compounds other than gold compounds, such as complex salts of platinum, palladium, and iridium, may be used as well. Specific examples of usable noble metal compounds are described in U.S. Pat. No. 2,448,060 and British Patent 618,061.

Sulfur sensitization is carried out by using sulfur compounds contained in gelatin or other various sulfur compounds, e.g., thiosulfates, thioureas, thiazoles, and rhodanines. Specific examples of these sulfur compounds are described in U.S. Pat. Nos. 1,574,944, 2,278,947, 2,410,689, 2,728,668, 3,501,313, and 3,656,955.

Reduction sensitization is performed by using stannous salts, amines, formamidinesulfinic acid, silane compounds, etc. Specific examples of these reducing agents are described in U.S. Pat. Nos. 2,487,850, 2,518,698, 2,983,609, 2,983,610, and 2,694,637.

For the purpose of increasing sensitivity and broadening sensitivity to a desired wavelength region, the silver halide emulsions can be optically sensitized. Optical sensitization can be effected by using sensitizing dyes, such as cyanine dyes and merocyanine dyes, either individually or in combinations thereof to achieve spectral sensitization or supersensitization.

With respect to these sensitization techniques, reference can be made to U.S. Pat. Nos. 2,688,545, 2,912,329, 3,397,060, 3,615,635, and 3,628,964, JP-B-43-4936, JP-B-44-14030 (the term "JP-B" as used herein means an "examined published Japanese patent application"), and JP-A-55-52050.

For the purpose of preventing fog during preparation, preservation or photographic processing or stabilizing photographic performance properties, the photographic emulsions may contain a variety of compounds, such as azoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole); mercaptopyrimidines; mercaptotriazines; thioketo compounds, e.g., oxazolinethione; azaindenes, e.g., triazaindenes, tetraazaindenes (especially 4-hydroxy-substituted (1,3,3a,7)-tetraazaindenes) and benzaazaindenes; benzenethiosulfonic acid, benzenesulfinic acid, benzenesulfonic acid amide; and many other compounds known as antifoggants or stabilizers. Particularly preferred of them are benzotriazoles (e.g., 5-methylbenzotriazole) and nitroindazoles (e.g., 5-nitroindazole). These compounds may also be incorporated into a processing solution.

The photographic emulsion layer or other hydrophilic colloidal layer of the light-sensitive material of the invention may contain an organic or inorganic hardening agent. Examples of suitable hardening agents are chromates (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloyl-hexahydro-s-triazine and 1,3-vinylsulfonyl-2-propanol), active halogen compounds (e.g., 2,4-dichloro-6-hydroxy-s-triazine), mucohalogenic acids (e.g., mucochloric acid and mucophenoxychloric acid), etc., either individually or in combination thereof.

The photographic emulsion layer or other hydrophilic colloidal layer of the light-sensitive material of the present invention may contain various surface active agents as coating aid, as anti-static agent, for improvement of sliding properties, as emulsification and dispersion aid, for prevention of adhesion, and for improvement of photographic characteristics (for example, acceleration of development, increase of contrast, and increase of sensitivity).

Examples of suitable surface active agents include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglycerides and alkylphenol polyglycerides), fatty acid esters of polyhydric alcohols, and alkyl esters of sugars; anionic surface active agents containing an acidic group, e.g., a carboxyl group, a sulfo group, a phospho group, a sulfuric acid ester group, a phosphoric acid ester group, etc., such as alkylcarboxylates, alkylsulfonates, alkylbenzenesulfonates, alkylnaphthalenesulfonates, alkylsulfates, alkylphosphates, N-acyl-N-alkyltaurines, sufosuccinic esters, sulfoalkylpolyoxyethylene alkylphenyl ethers, and polyoxyethylene alkylphosphates; amphoteric surface active agent such as amino acids, aminoalkylsulfonic acids, aminoalkyl sulfates as phosphates, alkylbetaines, amine oxides; and cationic surface active agents, such as alkylamine salts, aliphatic or aromatic quaternary ammonium salts, heterocyclic quaternary ammonium salts (e.g., pyridinium and imidazolium), and phosphonium or sulfonium salts containing an aliphatic or heterocyclic group.

Particularly preferred of these surface active agents are polyalkylene oxides having a molecular weight of 600 or more as described in JP-B-58-9412.

For the purpose of improving dimensional stability and the like, the photographic emulsion layer or other hydrophilic colloid layer can contain a dispersion of a water-insoluble or sparingly water-soluble synthetic polymer. Examples of such a polymer include homopolymers or copolymers of an alkyl (meth)acrylate, an alkoxyalkyl (meth)acrylate, glycidyl (meth)acrylate, (meth)acrylamide, a vinyl ester (e.g., vinyl acetate), acrylonitrile, an olefin, and a styrene; and copolymers comprising these monomers and acrylic acid, methacrylic acid, an $\alpha,\beta$-unsaturated dicarboxylic acid, a hydroxyalkyl (meth)acrylate, a sulfoalkyl (meth)acrylate, a styrenesulfonic acid, etc.

A developer which can be used for development processing of the photographic material according to this invention preferably contains a dihydroxybenzene developing agent as a main developing agent and a p-aminophenol developing agent or a 3-pyrazolidone developing agent as an auxiliary developing agent.

Examples of suitable dihydroxybenzene developing agents include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone, with hydroquinone being preferred.

Examples of suitable 1-phenyl-3-pyrazolidone developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of suitable p-aminophenol developing agents include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with N-methyl-p-aminophenol being preferred.

The dihydroxybenzene developing agent is usually used at a concentration of from 0.05 to 0.8 mol/l. When the dihydroxybenzene developing agent is combined with the 1-phenyl-3-pyrazolidone or p-aminophenol auxiliary developing agent, the former is preferably used at a concentration of from 0.05 to 0.5 mol/l, and the latter at a concentration of not more than 0.06 mol/l.

The developer contains a sulfite preservative, such as sodium sulfite, potassium sulfite, lithium sulfite, sodium bisulfite, potassium metabisulfite, and formaldehyde-sodium bisulfite. The sulfite is used at a concentration of 0.3 mol/l or more. Since an excess sulfite preservative would be precipitated in the developer to cause contamination of the developer, the upper limit of the sulfite concentration is preferably 1.2 mol/l.

The developer may contain, as a development accelerator, a tertiary amine compound, and particularly the compound described in U.S. Pat. No. 4,269,929.

The developer may further contain a pH buffering agent, such as boric acid, borax, sodium tertiary phosphate, and potassium tertiary phosphate and, in addition, those described in JP-A-60-93433.

The developer may furthermore contain a development inhibitor, e.g., potassium bromide and potassium iodide; an organic solvent, e.g., ethylene glycol, diethylene glycol, triethylene glycol, dimethylformamide, methyl cellosolve, hexylene glycol, ethanol, and methanol; and an antifoggant or black pepper inhibitor, such as indazole compounds, e.g., 5-nitroindazole, and benzotriazole compounds, e.g., sodium 2-mercaptobenzimidazole-5-sulfonate, 5-methylbenzotriazole. In particular, when 5-nitroindazole or the like compound is used, it is usually incorporated into a developer by preparing a solution thereof separately from a portion containing a dihydroxybenzene developing agent, a sulfite preservative, etc., mixing these portions upon use, and adding water to the mixture. The solution of 5-nitroindazole may be rendered alkaline to make it yellow-colored for the sake of ease in handling.

If desired, the developer may also contain a color toning agent, a surface active agent, a water softener, and a hardening agent.

A fixer having a generally known composition can be used. Suitable fixing agents include thiosulfates, thiocyanates, and organic sulfur compounds known to have fixing effects. The fixer may contain a water-soluble aluminum salt, e.g., aluminum sulfate and alum, as a hardening agent. The water-soluble aluminumsalt is usually added in a concentration of up to 3.0 g-Al/l. The fixer may further contain an (ethylenediaminetetraacetato)iron (III) complex salt as an oxidizing agent.

Processing is usually carried out at a temperature between 18° C. and 50° C. Processing temperatures of lower than 18° C. or higher than 50° C. are also employable.

The present invention is now illustrated in greater detail by way of the following Examples, but it should be understood that the present invention is not deemed to be limited thereto. All the percents, parts, and ratios are by weight unless otherwise specified.

EXAMPLE 1

Preparation of Emulsion:

Five grams of potassium bromide, 0.05 g of potassium iodide, 30 g of gelatin, and 2.5 ml of a 5% aqueous solution of a thioether, $HO(CH_2)_2S(CH_2)_2S(CH_2)_2OH$, were added to 1 l of water, and the resulting gelatin aqueous solution was kept at 73° C. An aqueous solution containing 8.33 g of silver nitrate and an aqueous solution containing 5.94 g of potassium bromide and 0.726 g of potassium iodide were added to the gelatin aqueous solution over 45 seconds with stirring according to a double jet process. Subsequently, 2.5 g of potassium bromide was added thereto, and an aqueous solution containing 8.33 g of silver nitrate was then added thereto over 26 minutes at such an increasing feed rate that the rate at the beginning of the addition was doubled at the end. Then, 20 ml of a 25% aqueous ammonia and 10 ml of a 50% aqueous solution of ammonium nitrate were added to the mixture. After physical ripening for 20 minutes, 240 ml of 1N sulfuric acid was added thereto for neutralization. To the mixture were then added an aqueous solution containing 153.34 g of silver nitrate and a potassium bromide aqueous solution over 40 minutes while controlling the pAg value at 8.2 in accordance with a controlled double jet process at such an increasing feed rate that the rate at the end of the addition was 9 times the rate at the beginning. After completion of the addition, 15 ml of a 2N potassium thiocyanate solution was added, and 25 ml of a 1% potassium iodide aqueous solution was further added thereto over 30 seconds. The temperature was lowered to 35° C. to remove soluble salts by a flocculation method. The temperature was raised to 40° C., and 30 g of gelatin and 2 g of phenol were added to the resulting emulsion. The emulsion was adjusted to have a pH of 6.40 and a pAg of 8.10 with sodium hydroxide and potassium bromide.

After the temperature of the emulsion was elevated to 56° C., 600 mg of a sensitizing dye shown below and 150 mg of a stabilizer shown below were added thereto. Ten minutes later, 2.4 mg of sodium thiosulfate pentahydrate, 140 mg of potassium thiocyanate, and 2.1 mg of chloroauric acid were added to the emulsion. Eighty minutes later, the emulsion was cooled to solidify. The resulting emulsion was found to comprise grains having an aspect ratio of 3 or more in a proportion of 98% based on the projected area of the total grains. All the grains having an aspect ratio of 2 or more had an average projected area diameter of 1.4 μm with a standard deviation of 15%, an average thickness of 0.187 μm, and an average aspect ratio of 7.5.

Sensitizing Dye:

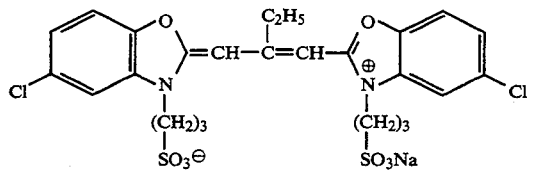

Stabilizer:

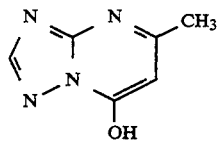

Preparation of Emulsion Coating Composition:

To the above-prepared emulsion were added the following compounds in amounts shown below per mol of silver halide to prepare a coating composition for an emulsion layer.

| | |
|---|---|
| Gelatin to make an Ag/total binder (gelatin + polymer (i.e., water-soluble polymer and polymer latex)) ratio of 1.0 | |
| Water-soluble polyester ("WD-SIZE" produced by Eastman Chemical Co.) | 15.0 g |
| Polymer latex (ethyl acrylate/methacrylic acid copolymer (97/3)) | 25.0 g |
| Hardening agent (1,2-bis(sulfonyl-acetamido)ethane) | 8 mmol/100 g of gelatin in surface protective layer and emulsion layer |
| Compound of formula (I) or comparative compound | see Table 1 |
| 2,6-Bis(hydroxyamino)-4-diethyl-amino-1,3,5-triazine | 80 mg |
| Sodium polyacrylate (average molecular weight: 41,000) | 4.0 g |
| Potassium polystyrenesulfonate (average molecular weight: 600,000) | 1.0 g |

The coating composition was coated simultaneously with a coating composition for a surface protective layer shown below on a 175 μm thick transparent polyethylene terephthalate (PET) support to a silver coverage of 2.0 g/m$^2$. The thus prepared photographic materials were designated Samples 101 to 113.

Surface Protective Layer Formulation:

| | |
|---|---|
| Gelatin | 1.15 g/m$^2$ |
| Polyacrylamide (average molecular weight: 45,000) | 0.25 g/m$^2$ |
| Sodium polyacrylate (average molecular weight: 400,000) | 0.02 g/m$^2$ |
| Sodium salt of sulfonated p-t-octyl-phenoxydiglycerylbutyl | 0.02 g/m$^2$ |
| Poly(polymerization degree: 10)oxy-ethylene cetyl ether | 0.035 g/m$^2$ |
| Poly(polymerization degree: 10)oxy-ethylene-poly(polymerization degree: 3)oxyglyceryl p-octylphenoxy ether | 0.01 g/m$^2$ |
| $C_8F_{17}SO_3K$ | 0.003 g/m$^2$ |
| $C_8F_{17}SO_2N(C_3H_7)(CH_2)_4(CH_2)_4SO_3Na$ | 0.001 g/m$^2$ |
| $C_8H_{17}SO_2N(C_3H_7)(CH_2CH_2O)_{10}(CH_2CHCH_2O)_4H$ | 0.003 g/m$^2$ |
| Polymethyl methacrylate (average particle size: 3.5 μm) | 0.025 g/m$^2$ |
| Poly(methyl methacrylate/methacrylate) (molar ratio = 7/3; average particle size: 2.5 μm) | 0.020 g/m$^2$ |

Sensitivity and abrasion resistance of each of Samples 101 to 113 were evaluated according to the following test methods. The results of the evaluations are shown in Table 1 below.

1) Sensitivity:

The sample was exposed to green light having a wavelength peak at 550 nm for 1/20 second and subjected to SP processing (dry-to-dry time: 45 seconds) at 35° C. by using an automatic developing machine "FPM 9000", a developer "RD 7" and a fixer "Fuji F" all produced by Fuji Photo Film Co., Ltd.

A reciprocal of an exposure which provided a density of fog +1.0 was taken as sensitivity, expressed relatively taking that of Sample 101 as a standard (100).

2) Abrasion Resistance:

The sample was conditioned at 25° C. and 25% RH for 1 hour and, under the same conditions, scratched by rubbing with a commercially available nylon brush over an area of 2 cm×1 cm under a load of 100 g at a speed of 1 cm/sec. The scratched sample (unexposed) was development-processed in the same manner as described in 1) above. The number of abrasion marks (black streaks) was counted.

TABLE 1

| Sample No. | Compound Added: Kind | Compound Added: Amount Added (g/mol-Ag) | Relative Sensitivity | Number of Abrasion Marks | Remark |
|---|---|---|---|---|---|
| 101 | — | — | 100 | 55 | Comparison |
| 102 | I-1 | 0.5 | 107 | 23 | Invention |
| 103 | " | 1.0 | 100 | 17 | " |
| 104 | I-13 | 0.5 | 110 | 26 | " |
| 105 | " | 1.0 | 105 | 20 | " |
| 106 | I-15 | 0.5 | 100 | 24 | " |
| 107 | " | 1.0 | 98 | 21 | " |
| 108 | I-20 | 0.5 | 102 | 25 | " |
| 109 | " | 1.0 | 98 | 18 | " |

TABLE 1-continued

| Sample No. | Compound Added Kind | Amount Added (g/mol-Ag) | Relative Sensitivity | Number of Abrasion Marks | Remark |
|---|---|---|---|---|---|
| 110 | 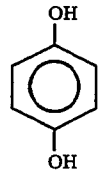 | 2.0 | 93 | 49 | Comparison |
| 111 | " | 4.0 | 81 | 43 | " |
| 112 | 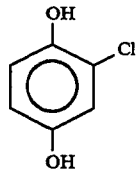 | 2.0 | 91 | 47 | " |
| 113 | " | 4.0 | 78 | 40 | " |

It can be seen from the results in Table 1 that the photographic materials containing the compound represented by formula (I) according to the present invention have improved abrasion resistance without undergoing reduction in sensitivity, whereas the comparative materials (Samples 110 to 113) containing comparative compounds, though showing a slight improvement in abrasion resistance, suffer from reduction of sensitivity.

EXAMPLE 2

On both sides of a 175 μm pan thick PET film dyed in blue was coated a subbing layer having the following formulation.

Subbing Layer Formulation:

Gelatin 84 mg/m$^2$

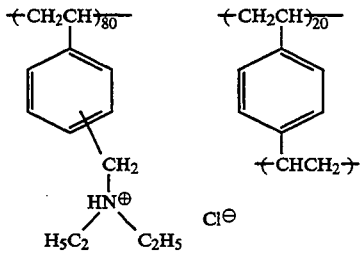

60 mg/m$^2$

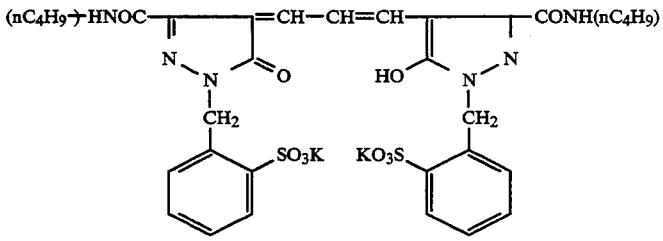

17 mg/m$^2$

An emulsion coating composition having the same composition as in Example 1, except for using the compound represented by formula (I) or a comparative compound shown in Table 2 below and changing the amount of the hardening agent to 15 mmol/100 g-gelatin, was coated on each side of the support having the subbing layer to a silver coverage of 1.9 g/m$^2$ per the layer. The same surface protective layer as used in Example 1 was also coated on each side. The resulting photographic materials were designated Sample 201 to 213.

Sensitivity, abrasion resistance, and drying properties of the resulting samples were evaluated as follows, and the results obtained are shown in Table 2.

1) Sensitivity:

The sample was exposed from both sides with the other exposing conditions being the same as in Example 1, and the exposed sample was automatically processed as follows.

Development Procedure:

| Step | Temperature (°C.) | Time (sec) | Volume of Tank (l) |
|---|---|---|---|
| Development | 35 | 12.5 | 6.5 |
| Fixing | 35 | 10 | 6.5 |
| Washing | 20 | 7.5 | 6.5 |
| Drying | 50 | | |

-continued

| Dry-to-Dry Time = 48 seconds | |
|---|---|
| Formulation of Concentrated Developer | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 11.0 g |
| 5-Methylbenzotriazole | 2 g |
| Water to make | 1 l |
| pH | 10.60 |
| Formulation of Concentrated Fixer | |
| Ammonium thiosulfate | 560 g |
| Sodium sulfite | 60 g |
| Disodium ethylenediaminetetraacetate dehydrate | 0.10 g |
| Sodium hydroxide | 24 g |
| Water to make | 1 l |
| pH (adjusted with acetic acid) | 5.10 |

When development was started, each tank was filled with the following processing solution.

| | |
|---|---|
| Developing Tank: | 333 ml of the concentrated developer, 667 ml of water, and 10 ml of a starter containing 2 g of potassium bromide and 1.8 g of acetic acid. Adjusted to a pH of 10.15. |
| Fixing Tank: | 250 ml of the fixer and 750 ml of water. |

Relative sensitivity was determined in the same manner as in Example 1.

2) Abrasion Resistance:

The same as in Example 1, except that the development processing was conducted in the same manner as described in 1) above.

3) Drying Properties: The sample cut to a size of 24.5 cm×30.5 cm was subjected to automatic development in the same manner as described in 1) above. The drying state of the processed film immediately taken from the drying zone was evaluated by touching with a hand and rated as follows.

Excellent: The film is considerably warm and sufficiently dry.

Good: The film is slightly warm and dry.

No good: The film is rather damp and insufficiently dry.

Poor: The film is wet and adheres to each other.

TABLE 2

| Sample No. | Compound Added: Kind | Compound Added: Amount Added (g/mol-Ag) | Relative Sensitivity | Number of Abrasion Marks | Drying Properties | Remark |
|---|---|---|---|---|---|---|
| 201 | — | — | 100 | 48 | Excellent | Comparison |
| 202 | I-5 | 0.3 | 105 | 12 | Excellent | Invention |
| 203 | " | 0.6 | 110 | 7 | Good | " |
| 204 | I-11 | 0.3 | 107 | 15 | Excellent | " |
| 205 | " | 0.6 | 115 | 11 | Excellent | " |
| 206 | I-16 | 0.3 | 110 | 13 | Excellent | " |
| 207 | " | 0.6 | 107 | 6 | Good | " |
| 208 | I-22 | 0.3 | 105 | 10 | Excellent | " |
| 209 | " | 0.6 | 100 | 8 | Excellent | " |
| 210 | 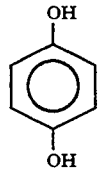 | 1.5 | 95 | 39 | No good | Comparison |
| 211 | " | 3.0 | 87 | 33 | Poor | " |
| 212 | 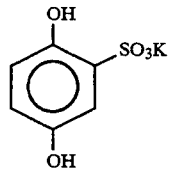 | 1.5 | 91 | 42 | No good | " |
| 213 | " | 3.0 | 83 | 36 | Poor | " |

It is apparent from the results in Table 2 that the samples containing the compound represented by formula (I) according to the present invention exhibit excellent drying properties, high sensitivity, and satisfactory abrasion resistance.

EXAMPLE 3

Emulsions A to E were prepared as follows.

Preparation of Regular Octahedral Silver Halide Emulsion:

To a gelatin aqueous solution comprising 1 l of water, 25 g of gelatin, and potassium bromide were added a silver nitrate aqueous solution and a halogen aqueous solution containing potassium bromide and potassium iodide while maintaining a pAg at 8.7 in accordance with a double jet process to prepare a regular octahedral silver iodobromide emulsion having a mean grain size of 0.8 μm. The emulsion was chemically sensitized with sodium thiosulfate and chloroauric acid to obtain a regular octahedral light-sensitive silver iodobromide emulsion having a pAg of 8.6, a pH of 6.4, and an iodide content of 8 mol %. The resulting emulsion was designated Emulsion A.

Preparation of Amorphous Silver Halide (Thick Tabular Twin) Emulsion:

To a gelatin aqueous solution comprising 1 l of water, 25 g of potassium bromide, 4.5 g of potassium iodide, 9 ml of 2N potassium thiocyanate, and 24 g of gelatin were added a silver nitrate aqueous solution and a potassiumbromide aqueous solution in accordance with a double jet process by a usual ammonia method to prepare an emulsion comprising thick tabular (relatively near to amorphous) silver iodobromide grains having a mean grain size of 1.0 μm and a iodide content of 3 mol %. The emulsion was chemically sensitized with sodium thiosulfate and chloroauric acid to obtain a light-sensitive silver iodobromide emulsion having a pAg of 8.6 and a pH of 6.4. This emulsion was designated Emulsion B.

A light-sensitive silver iodobromide emulsion having an iodide content of 6 mol % and a mean grain size of 0.6 μm (designated as Emulsion C) was prepared in the same manner as for Emulsion B, except that the gelatin aqueous solution further contained 9 g of potassium iodide.

A light-sensitive silver iodobromide emulsion having an iodide content of 8 mol % and a mean grain size of 1.0 μm (designated as Emulsion D) was prepared in the same manner as for Emulsion B, except that the gelatin aqueous solution further contained 8 g of potassium iodide and that 4 g of potassium iodide was added to the halogen aqueous solution to be added by a double jet process.

Preparation of Tabular Silver Halide Emulsion:

To a gelatin aqueous solution comprising 1 l of water, 5 g of potassium bromide, and 30 g of gelatin were added a 5% portion of a silver nitrate aqueous solution and a mixed aqueous solution of potassium bromide and potassium iodide while maintaining a pAg at 9.5, and a 5% portion of the silver nitrate aqueous solution was then added thereto in accordance with a single jet process. Further, the remaining portion (90%) of the silver nitrate aqueous solution and a mixed aqueous solution of potassium bromide and potassium iodide were added thereto while maintaining a pAg at 8.1 in accordance with a double jet process to prepare an emulsion comprising tabular silver iodobromide grains having an aspect ratio of 6.5 and an average projected area diameter of 1.3 μm with a standard deviation of 15%. The emulsion was chemically sensitized with sodium thiosulfate and chloroauric acid to obtain a light-sensitive silver iodobromide emulsion having a pAg of 8.6, a pH of 6.4, and an iodide content of 3 mol %. This emulsion was designated as Emulsion E.

Preparation of Photographic Material:

On a triacetyl cellulose film having a subbing layer on the side to be coated with an emulsion layer and a backing layer having the following formulation on the reverse side thereof, an emulsion layer and a surface protective layer each having the following formulation were coated to prepare a photographic material. The resulting samples were designated as Samples 301 to 325.

Backing Layer Formulation:

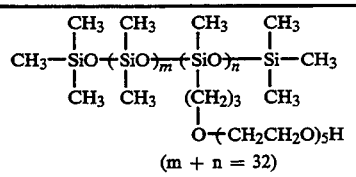

10 mg/m²

(m + n = 32)

-continued

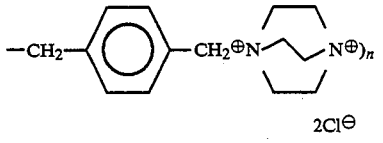

60 mg/m²

| | |
|---|---|
| Diacetyl cellulose | 143 mg/m² |
| Silicon oxide | 5 mg/m² |

Emulsion Layer Formulation:

| | |
|---|---|
| Emulsion A, B, C, D or E | 3.5 g of Ag/m² |
| Gelatin | 1.5 g/g of Ag |
| 4-Hydroxy-6-methyl-1,3,3a,7-tetraazaindene | 10 mg/g of Ag |
| Polyethylene oxide | 8 mg/g of Ag |
| Poly(potassium p-vinylbenzenesulfonate) | 20 mg/g of Ag |
| Sensitizing dye of formula: | 230 mg/mol of Ag |

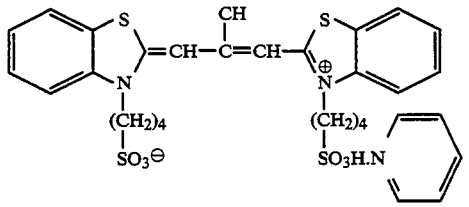

| | |
|---|---|
| The compound of formula (I) or a comparative compound | see Table 3 |
| Hardening agent (Bis(vinylsulfonylacetamido)ethane) | see below |

The hardening agent was added to the emulsion in such an amount that the resulting coated sample, after preserved at 25° C. and 65% RH for 7 days, be swollen to a thickness of 200±10% of the dry thickness on soaking in distilled water at 25° C. for 3 minutes.

Surface Protective Layer Formulation:

| | |
|---|---|
| Gelatin | 0.8 g/m² |
| Poly(potassium p-vinylbenzenesulfonate) | 1 mg/m² |
| Polymethyl methacrylate fine particles (average particle size: 3 μm) | 0.13 mg/m² |

Sensitivity, abrasion resistance, and preservability with time of each sample were evaluated as follows. The results of these evaluations are shown in Table 3 below.

1) Sensitivity:

After preserved at 25° C. and 65% RH for 7 days, the sample was exposed to light through a filter having a wavelength distribution corresponding to sunlight for 1/100 second. The exposed sample was developed with a developer having the following formulation at 20° C. for 7 minutes, fixed with a fixer having the following formulation, washed with water, and dried.

The sensitivity of the sample was determined at a density of fog +0.3 and expressed relatively taking that of a sample containing neither the compound of formula (I) nor a comparative compound (blank) for each emulsion as a standard (100).

Developer Formulation:

| | |
|---|---|
| Metol | 2 g |
| Anhydrous sodium sulfite | 100 g |

-continued

| | |
|---|---|
| Hydroquinone | 5 g |
| Boric acid | 2 g |
| Water to make | 1 l |
| pH adjusted to | 8.7 |

Fixer-Formulation:

| | |
|---|---|
| Sodium thiosulfate | 240 g |
| Anhydrous sodium sulfite | 15 g |
| 28% Acetic acid | 48 ml |
| Boric acid | 7.5 g |
| Potash alum | 15 g |
| Water to make | 1 l |

2) Abrasion Resistance:

The sample was scratched with a nylon brush in the same manner as in Example 1 and then subjected to development processing in the same manner as described in 1) above. The abrasion resistance was evaluated by counting the number of abrasion marks in the same manner as in Example 1.

3) Preservability After Storage (Fog After Storage):

The sample was preserved at 25° C. and 65% RH for 10 days or at 40° C. and 75% RH for 10 days. Each sample was subjected to sensitometry in the same manner as described in 1) above, and the fog density was compared. The difference between the higher fog density of the former sample and the lower fog density of the latter sample was obtained as an indication of preservability after storage.

TBALE 3

| Sample No. | Emulsion Used | Compound Added Kind | Compound Added Amount (g/mol-Ag) | Relative Sensitivity | Number of Abrasion Marks | Fog After Storage | Remark |
|---|---|---|---|---|---|---|---|
| 301 | A | — | — | 100 | 61 | 0.045 | Comparison |
| 302 | B | — | — | 100 | 75 | 0.037 | " |
| 303 | C | — | — | 100 | 53 | 0.050 | " |
| 304 | D | — | — | 100 | 66 | 0.055 | " |
| 305 | E | — | — | 100 | 77 | 0.058 | " |
| 306 | A | 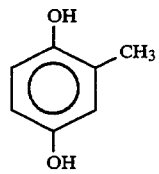 | 1.7 | 83 | 53 | 0.040 | " |
| 307 | B | " | " | 85 | 64 | 0.035 | " |
| 308 | C | " | " | 79 | 48 | 0.048 | " |
| 309 | D | " | " | 87 | 59 | 0.050 | " |
| 310 | E | " | " | 85 | 61 | 0.052 | " |
| 311 | A | I-3 | 0.2 | 102 | 22 | 0.018 | Invention |
| 312 | B | " | " | 100 | 23 | 0.015 | " |
| 313 | C | " | " | 107 | 18 | 0.020 | " |
| 314 | D | " | " | 98 | 19 | 0.021 | " |
| 315 | E | " | " | 102 | 20 | 0.018 | " |
| 316 | A | I-7 | 0.3 | 107 | 20 | 0.015 | " |
| 317 | B | " | " | 110 | 18 | 0.017 | " |
| 318 | C | " | " | 105 | 17 | 0.016 | " |
| 319 | D | " | " | 100 | 15 | 0.015 | " |
| 320 | E | " | " | 102 | 18 | 0.018 | " |
| 321 | A | I-17 | 0.25 | 100 | 22 | 0.014 | " |
| 322 | B | " | " | 98 | 17 | 0.013 | " |
| 323 | C | " | " | 100 | 15 | 0.015 | " |
| 324 | D | " | " | 102 | 18 | 0.017 | " |
| 325 | E | " | " | 105 | 16 | 0.016 | " |

It is apparent from the results of Table 3 that Samples 311 to 325 containing the compound represented by formula (I) according to the present invention exhibit improved abrasion resistance without decrease of sensitivity and that an increase of fog after storage is suppressed in these samples.

Moreover, the samples according to the present invention revealed an increase in contrast in the toe of the characteristic curve (so-called sharp toe cut) and an effect of development acceleration where a development time was short.

EXAMPLE 4

Photographic materials (designated Sample 401 to 411) were prepared by coating the following layers on a support in the order listed.

| | |
|---|---|
| 1st Layer: | |
| Gelatin | 0.6 g/m$^2$ |
| 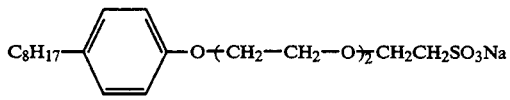 | 3.6 mg/m$^2$ |
| Poly(potassium p-vinylbenzenesulfonate) | 9 mg/m$^2$ |

-continued

2nd Layer:

Gelatin 1.0 g/m$^2$

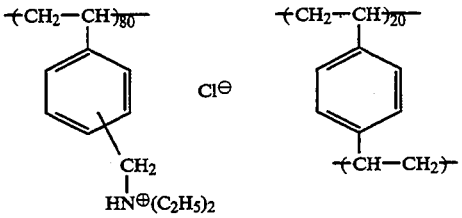

175 mg/m$^2$

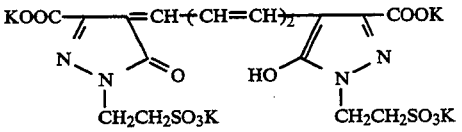

26 mg/m$^2$

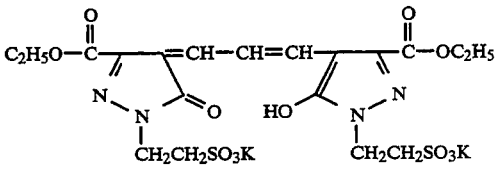

16 mg/m$^2$

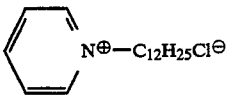

15 mg/m$^2$

HCl 0.11 mg/m$^2$

3rd Layer:

Gelatin 0.4 g/m$^2$

Poly(potassium p-vinylbenzenesulfonate) 5 mg/m$^2$

4th Layer:

Emulsion C of Example 3 1.36 g of Ag/m$^2$

Gelatin 2.0 g/m$^2$

4-Hydroxy-6-methyl-1,3,3a,7-tetraazaindene 30 mg/m$^2$

Polyethylene oxide 7 mg/m$^2$

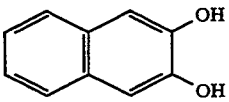

1.5 mg/m$^2$

Poly(potassium p-vinylbenzenesulfonate) 50 mg/m$^2$

5th Layer:

Emulsion D of Example 3 4.6 g of Ag/m$^2$

Gelatin 7.0 g/m$^2$

4-Hydroxy-6-methyl-1,3,3a,7-tetraazaindene 41 mg/m$^2$

Polyethylene oxide 23 mg/m$^2$

Poly(potassium p-vinylbenzenesulfonate) 88 mg/m$^2$

Uppermost Layer:

Gelatin 0.8 g/m$^2$

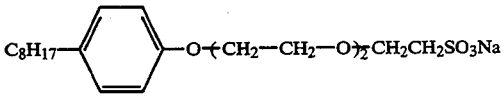

13 mg/m$^2$

Polymethyl methacrylate fine particles (average particle size: 3 μm) 0.13 mg/m$^2$ Poly(potassium p-vinylbenzenesulfonate) 6 mg/m$^2$ -continued

| | |
|---|---|
| 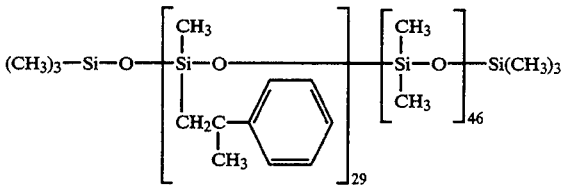 | 42 mg/m$^2$ |
| $C_{15}H_{31}COOC_{16}H_{33}$ | 50 mg/m$^2$ |
| $C_8F_{17}SO_2-N(C_3H_7)-CH_2COOK$ | 1.8 mg/m$^2$ |

Hardening of layers was controlled by adding bis(-vinylsulfonylacetamido)ethane in such an amount that the resulting coated sample, after preserved at 25° C. and 65% RH for 7 days, be swollen to a thickness of 300%±10 of the dry thickness on immersion in distilled water at 25° C. for 3 minutes.

To each of Emulsions C and D was added 230 mg/mol-Ag of the same dye as used in Example 3 before it was subjected to after-ripening.

The compound represented by formula (I) or a comparative compound was added to a layer shown in Table 4 below in an amount shown in the Table.

Each of the resulting photographic materials was evaluated in the same manner as in Example 3, and the results obtained are shown in Table 4.

TABLE 4

| Sample No. | Layer | Compound Added Kind | Compound Added Amount (g/mol-Ag) | Relative Sensitivity | Number of Abrasion Marks | Fog After Storage | Remark |
|---|---|---|---|---|---|---|---|
| 401 | — | — | — | 100 | 58 | 0.053 | Comparison |
| 402 | 1st | hydroquinone | 1.5 | 85 | 47 | 0.050 | " |
| 403 | 2nd | " | " | 87 | 45 | 0.048 | " |
| 404 | 3rd | " | " | 85 | 48 | 0.047 | " |
| 405 | 4th | " | " | 85 | 43 | 0.051 | " |
| 406 | 5th | " | " | 83 | 46 | 0.049 | " |
| 407 | 1st | I-2 | 0.2 | 107 | 17 | 0.017 | Invention |
| 408 | 2nd | " | " | 105 | 15 | 0.020 | " |
| 409 | 3rd | " | " | 105 | 18 | 0.018 | " |
| 410 | 4th | " | " | 102 | 18 | 0.018 | " |
| 411 | 5th | " | " | 107 | 15 | 0.019 | " |

As is apparent from the results of Table 4, Samples 407 to 411 according to the present invention demonstrate the effects of the compound represented by formula (I) to improve abrasion resistance and resistance to fog after storage irrespective of which layer it is added to.

EXAMPLE 5

A silver nitrate aqueous solution and a mixed aqueous solution of potassium bromide and potassium iodide were mixed in the presence of ammonia while maintaining a pAg at 7.9 according to a double jet process to prepare a mono-dispersed cubic silver iodobromide emulsion having a mean grain size of 0.2 μm (silver iodide content: 2.0 mol %; silver bromide content: 98.0 mol %).

To the emulsion was added $3\times10^{-5}$ mol/mol-Ag of sodium thiosulfate as a chemical sensitizer to conduct sulfur sensitization.

To the emulsion was added $6\times10^{-4}$ mol/mol-Ag of 5,5'-dichloro-3,3'-di(3-sulfopropyl)-9-ethyl-oxacarbocyanine sodium salt as a sensitizing dye to conduct spectral sensitization.

To the emulsion were further added 4-hydroxy-6-methyl-1,3,3a,7-tetraazaindene as a stabilizer, a compound of formula:

$$C_{17}H_{33}CON(CH_3)-CH_2CH_2SO_3Na$$

and sapon as coating aids, $CH_2{=}CHSO_2CH_2CONH(CH_2)_nNHCOCH_2SO_2CH{=}CH_2$ (n=2 or 3 ) as a vinylsulfone type hardening agent, sodium polystyrenesulfonate as a thickener, and 0.30 g/m$^2$ of a polyethyl acrylate dispersion and 0.40 g/m$^2$ of a compound shown below as latex polymers.

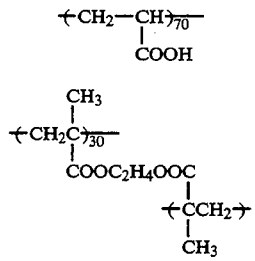

Further, 0.1 g of 1-phenylmercaptotetrazole was added per mol of the silver as an antifoggant, and $6.0\times10^{-4}$ mol of a hydrazine compound shown below was then added per mol of the silver.

Hydrazine Compound:

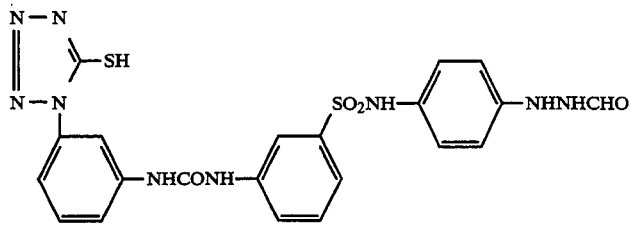

To the emulsion was furthermore added the compound represented by formula (I) or, for comparison, hydroquinone in an amount shown in Table 5 below.

The resulting emulsion coating composition was coated on a support to a silver coverage of 3.6 g/m$^2$. Simultaneously with the emulsion layer, a protective layer comprising a gelatin aqueous solution containing gelatin, sodium dodecylbenzenesulfonate, silicone oil, a fluorine surfactant, colloidal silica, a polyethyl acrylate dispersion, polymethyl methacrylate particles (particle size: 2.5 μm) as a matting agent, and sodium polystyrenesulfonate as a thickener was also coated to a gelatin coverage of 1.6 g/m$^2$.

A set of two films were thus prepared per sample. To evaluate abrasion resistance, one of the films was scratched with a sapphire stylus having a diameter of 0.025 mm under a load of 2, 4, 6, 8, or 10 g. For sensitometry to determine sensitivity and gamma, the other film was used without scratching.

Each of the two films was exposed to tungsten light of 3200° K. through an optical wedge for sensitometry for 5 seconds, developed with a developer having the following formulation at 38° C. for 30 seconds, fixed, washed with water, and dried. For development processing, an automatic developing machine "FG-660F" manufactured by Fuji Photo Film Co., Ltd. was employed. Evaluations were made according to the following test methods (1) to (3), and the results obtained are shown in Table 5.

Developer Formulation:

| | |
|---|---|
| Hydroquinone | 50.0 g |
| N-Methyl-p-aminophenol hemisulfate | 0.3 g |
| Sodium hydroxide | 18.0 g |
| 5-Sulfosalicylic acid | 45.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonate | 0.2 g |

-continued

| | |
|---|---|
| N-n-Butyldiethanolamine | 15.0 g |
| Sodium toluenesulfonate | 8.0 g |
| Water to make | 1 l |
| pH (adjusted with potassium hydroxide) | 11.6 |

1) Sensitivity:

A sensitivity was read out from an exposure providing a density of fog +1.5 on the characteristic curve.

2) Gamma:

A gamma value was obtained from a slope of a straight line connecting a point of fog +0.3 (density) and a point of fog +3.0 (density) on the characteristic curve, i.e., from equation:

$$\gamma = \frac{3.0 - 0.3}{\log(\text{exposure amount at fog} + 3.0) - \log(\text{exposure amount at fog} + 0.3)}$$

A gamma value is preferably 10 or more for image quality.

3) Abrasion Resistance:

The degree of abrasion mark at the area having a slight background density which corresponded to the toe of the characteristic curve was observed with eyes. The load for scratching being increased, the point at which abrasion mark was recognized was recorded. The higher the load value, the higher the abrasion resistance. A preferred abrasion resistance is 6 g or more.

TABLE 5

| Sample No. | Compound Added Kind | Amount (mol/mol-Ag) | Sensitivity | Gamma (γ) | Scratch Resistance | Remark |
|---|---|---|---|---|---|---|
| 501 | — | — | 100 | 16 | 2 | Comparison |
| 502 | I-1 | $7 \times 10^{-4}$ | 102 | 16 | 8 | Invention |
| 503 | " | $2 \times 10^{-3}$ | 98 | 15 | 10 or more | " |
| 504 | I-3 | $7 \times 10^{-4}$ | 100 | 17 | 10 | " |
| 505 | " | $2 \times 10^{-3}$ | 95 | 16 | 10 or more | " |
| 506 | I-7 | $7 \times 10^{-4}$ | 98 | 16 | 10 | " |
| 507 | " | $2 \times 10^{-3}$ | 95 | 16 | 10 or more | " |
| 508 | I-8 | $7 \times 10^{-4}$ | 102 | 16 | 8 | " |
| 509 | " | $2 \times 10^{-3}$ | 95 | 14 | 10 | " |
| 510 | I-13 | $7 \times 10^{-4}$ | 100 | 17 | 9 | " |
| 511 | " | $2 \times 10^{-3}$ | 98 | 16 | 10 | " |
| 512 | hydroquinone | $2 \times 10^{-3}$ | 81 | 14 | 3 | Comparison |
| 513 | " | $8 \times 10^{-3}$ | 69 | 13 | 5 | " |

The results in Table 5 prove that the samples using the compound represented by formula (I) according to the present invention have markedly improved abrasion resistance without being accompanied by substantial reduction in sensitivity or gamma.

To the contrary, the samples using hydroquinone in place of the compound represented by formula (I) only show smaller improvement in abrasion resistance and reduced sensitivity as compared with the samples of the present invention.

EXAMPLE 6

A halogen salt aqueous solution and a silver nitrate aqueous solution were mixed at 45° C. for 60 minutes according to a double jet process to prepare a mono-dispersed cubic silver chloroiodobromide emulsion (silver iodide content: 0.1 mol %; silver bromide content: 30 mol %) having a mean grain size of 0.25 μm. The halogen salt aqueous solution contained $(NH_4)_3RhCl_6$ and $K_3IrCl_6$ in such amounts that the resulting emulsion contained $1\times10^{-7}$ mol/mol-Ag of the former and $4\times10^{-7}$ mol/mol-Ag of the latter.

After washing with water and desalting the emulsion, $5\times10^{-5}$ mol/mol-Ag of sodium thiosulfate was added to the emulsion to conduct sulfur sensitization. Then, $4\times10^{-5}$ mol/mol-Ag of potassium chloroaurate was added thereto to conduct gold sensitization.

To the emulsion were added $3\times10^{-4}$ mol/mol-Ag of potassium 1-(2-hydroxyethoxyethyl)-3-(pyridin-2-yl)-5-[(3-sulfobutyl-5-chloro-2-benzoxazolinidene)ethylidene]-2-thiohydantoin as a sensitizing dye and, as stabilizers, 1.5 g/mol-Ag of 4-hydroxy-6-methyl-1,3,3a,7-tetraazaindene, 2 g/mol-Ag of resorcin aldoxime, and 0.1 g/mol-Ag of 1-phenyl-5-mercaptotetrazole.

To the emulsion were further added saponin and a compound of formula:

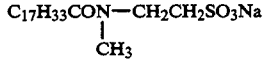

as coating aids, $CH_2{=}CHSO_2CH_2CONH(CH_2)_nNHCOCH_2SO_2CH{=}CH_2$ (wherein n=2 or 3) as a vinylsulfone type hardening agent, sodium polystyrenesulfonate as a thickener, and a polyethyl acrylate dispersion as a latex polymer.

A hydrazine compound of formula:

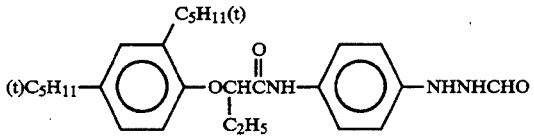

was added to the emulsion in an amount of $1.2\times10^{-3}$ mol/mol-Ag.

The compound of formula (I) or hydroquinone was added to the emulsion in an amount shown in Table 6 below.

As a protective layer, a gelatin aqueous solution comprising gelatin, sodium dodecylbenzenesulfonate, silicone oil, a fluorine surfactant, colloidal silica, a polyethyl acrylate dispersion, polyacrylamide (molecular weight: 5,000), polymethyl methacrylate (particle size: 2.5 μm) as a matting agent, and sodium polystyrenesulfonate as a thickener was used.

An emulsion layer and a protective layer were simultaneously coated on a support to a silver coverage of 3.6 g/m² and a gelatin coverage of 1.6 g/m², respectively.

The resulting photographic materials were designated Samples 601 to 613. The samples were scratched, exposed to light, and development-processed in the same manner as in Example 5, and evaluations were made in the same manner as in Example 5. The results obtained are shown in Table 6.

TABLE 6

| Sample No. | Compound Added Kind | Amount (mol/mol-Ag) | Sensitivity | Gamma (γ) | Scratch Resistance | Remark |
|---|---|---|---|---|---|---|
| 601 | — | — | 100 | 14 | 2 | Comparison |
| 602 | I-2 | $7\times10^{-4}$ | 108 | 15 | 10 | Invention |
| 603 | " | $2\times10^{-3}$ | 105 | 15 | 10 or more | " |
| 604 | I-5 | $7\times10^{-4}$ | 102 | 16 | 10 | " |
| 605 | " | $2\times10^{-3}$ | 98 | 14 | 10 or more | " |
| 606 | I-9 | $7\times10^{-4}$ | 100 | 14 | 10 | " |
| 607 | " | $2\times10^{-3}$ | 98 | 13 | 10 or more | " |
| 608 | I-11 | $7\times10^{-4}$ | 100 | 15 | 8 | " |
| 609 | " | $2\times10^{-3}$ | 95 | 14 | 10 | " |
| 610 | I-14 | $7\times10^{-4}$ | 102 | 14 | 8 | " |
| 611 | " | $2\times10^{-3}$ | 98 | 13 | 10 | " |
| 612 | hydroquinone | $2\times10^{-3}$ | 72 | 11 | 3 | Comparison |
| 613 | " | $8\times10^{-3}$ | 59 | 9 | 4 | " |

It can be seen from the results of Table 6 that the samples containing the compound of the present invention, in which a silver chloroiodobromide emulsion having been subjected to gold-sulfur sensitization was used, exhibit extremely improved abrasion resistance without undergoing reduction in sensitivity or gamma. As compared with the comparative compound (hydroquinone), the compounds represented by formula (I) according to the present invention were proved less causative of reduction in sensitivity and gamma and more effective to improve abrasion resistance.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one of a surface latent image silver halide emulsion layer and other hydrophilic colloid layers, wherein said at least one of an emulsion layer and other hydrophilic colloid layers contains a compound represented by formula (I):

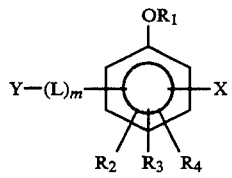

(I)

wherein X represents $$-OR_1 \text{ or } -N\begin{matrix}R_5\\R_6\end{matrix};$$

$R_1$ represents a hydrogen atom or a group capable of being converted to a hydrogen atom on hydrolysis; $R_2$, $R_3$ and $R_4$, which may be the same or different, each represents a hydrogen atom or a substituent group; $R_5$ and $R_6$, which may be the same or different, each represents a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group, or a substituted or unsubstituted carbamoyl group; Y represents a 5- or 6-membered heterocyclic group having a mercapto group or a benzotriazole group having a >NH structure therein; L represents a member selected from the group consisting of a divalent alkylene group, a divalent alkenylene group, a divalent alkynylene group, a divalent arylene group, —NH—, —N=, —CO—, —$SO_2$—, and combinations thereof; and m represents 0 or 1;

and wherein said at least one emulsion layer or other hydrophilic colloid layer containing a compound represented by formula (I) also contains a compound represented by formula (II) in an amount of from $1\times10^{-6}$ to $5\times10^{-2}$ mol per mol of the silver halide:

$$R^1-\underset{A_1}{N}-\underset{A_2}{N}-G_1-R^2 \qquad \text{(II)}$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, a substituted or unsubstituted aryloxy group, a substituted or unsubstituted amino group, or a substituted or unsubstituted hydrazino group; $G_1$ represents $$-C-,\quad -SO_2-,\quad -SO-,\quad -\overset{O}{\overset{\|}{P}}-_{R^2},\quad -\overset{O}{\overset{\|}{C}}-\overset{O}{\overset{\|}{C}}-,$$

a thiocarbonyl group, or an iminomethylene group; and $A_1$ and $A_2$ each represents a hydrogen atom, a substituted or unsubstituted alkylsulfonyl group, a substituted or unsubstituted arylsulfonyl group, or a substituted or unsubstituted acyl group, provided that at least one of $A_1$ and $A_2$ is a hydrogen atom and that $R_1$ or $R_2$ contains a ballast group or a group which accelerates adsorption of the compound of formula (II) onto the silver halide grain surface.

2. The silver halide photographic material as claimed in claim 1, wherein said compound represented by formula (I) is contained in an amount of from $1\times10^{-5}$ to $1\times10^{-1}$ mol per mol of the silver halide.

3. The silver halide photographic material as claimed in claim 1, wherein said compound represented by formula (I) is contained in said surface latent image type silver halide emulsion layer.

4. The silver halide photographic material as claimed in claim 1, wherein said compound represented by formula (II) is contained in said surface latent image type silver halide emulsion layer.

5. A silver halide photographic material comprising a support having thereon at least one of a surface latent image silver halide emulsion layer and other hydrophilic colloid layers, wherein said at least one of an emulsion layer and other hydrophilic colloid layers contains a compound represented by formula (I):

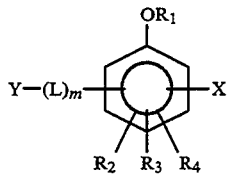

(I)

wherein X represents —N($R^5$)($R_6$); $R_1$ represents a hydrogen atom or a group capable of being converted to a hydrogen atom on hydrolysis; $R_2$, $R_3$ and $R_4$, which may be the same or different, each represents a hydrogen atom or a substituent group; $R_5$ and $R_6$, which may be the same or different, each represents a hydrogen atom, a substituted or unsubstituted alkyl group, a substituted or unsubstituted aryl group, a substituted or unsubstituted alkylsulfonyl group, a substituted or unsubstituted arylsulfonyl group, a substituted or unsubstituted alkylcarbonyl group, a substituted or unsubstituted arylcarbonyl group, or a substituted or unsubstituted carbamoyl group; Y is a group which accelerates adsorption onto silver halide grains; L represents a member selected from the group consisting of a divalent alkylene group, a divalent alkenylene group, a divalent alkynylene group, a divalent arylene group, —NH—, —N=, —CO—, —$SO_2$—, and combinations thereof; and m represents 0 or 1;

and wherein said at least one emulsion layer or other hydrophilic colloid layer containing a compound represented by formula (I) also contains a compound represented by formula (II) in an amount of from $1\times10^{-6}$ to $5\times10^{-2}$ mol per mol of the silver halide:

$$R^1-\underset{A_1}{N}-\underset{A_2}{N}-G_1-R^2 \qquad \text{(II)}$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group, a substituted or unsubstituted aryloxy group, a substituted or unsubstituted amino group, or a substituted or unsubstituted hydrazino group; $G_1$ represents $$-C-,\quad -SO_2-,\quad -SO-,\quad -\overset{O}{\overset{\|}{P}}-_{R^2},\quad -\overset{O}{\overset{\|}{C}}-\overset{O}{\overset{\|}{C}}-,$$

a thiocarbonyl group, or an iminomethylene group; and $A_1$ and $A_2$ each represents a hydrogen atom, a substituted or unsubstituted alkylsulfonyl group, a substituted or unsubstituted arylsulfonyl group, or a substituted or unsubstituted acyl group, provided that at least one of $A_1$ and $A_2$ is a hydrogen atom and that $R_1$ or $R_2$ contains a ballast group or a group which accelerates adsorption of the compound of formula (II) onto the silver halide grain surface.

6. The silver halide photographic material as claimed in claim 5, wherein said compound represented by formula (I) is contained in an amount of from $1\times10^{-5}$ to $1\times10^{-1}$ mol per mol of the silver halide.

7. The silver halide photographic material as claimed in claim 5, wherein said compound represented by formula (I) is contained in said surface latent image type silver halide emulsion layer.

8. The silver halide photographic material as claimed in claim 5, wherein said compound represented by formula (II) is contained in said surface latent image type silver halide emulsion layer.

* * * * *